US008289118B2

(12) United States Patent
Chiu et al.

(10) Patent No.: US 8,289,118 B2
(45) Date of Patent: Oct. 16, 2012

(54) STACKED INDUCTOR

(75) Inventors: Tzuyin Chiu, Shanghai (CN); Xiangming Xu, Shanghai (CN); Miao Cai, Shanghai (CN)

(73) Assignee: Shanghai Hua Hong NEC Electronics Co., Ltd., Shanghai (CN)

( * ) Notice: Subject to any disclaimer, the term of this patent is extended or adjusted under 35 U.S.C. 154(b) by 0 days.

(21) Appl. No.: 12/963,462

(22) Filed: Dec. 8, 2010

(65) Prior Publication Data

US 2011/0133879 A1 Jun. 9, 2011

(30) Foreign Application Priority Data

Dec. 8, 2009 (CN) ..... 2009 1 0201909

(51) Int. Cl.
*H01F 21/02* (2006.01)
*H01F 5/00* (2006.01)
*H01F 27/28* (2006.01)

(52) U.S. Cl. ..... 336/147; 336/200; 336/223; 336/222

(58) Field of Classification Search ..... 336/200, 336/223, 232, 147, 222
See application file for complete search history.

(56) References Cited

U.S. PATENT DOCUMENTS

| | | | | |
|---|---|---|---|---|
| 6,438,000 | B1 * | 8/2002 | Okamoto et al. | 363/40 |
| 7,671,714 | B2 * | 3/2010 | Tiemeijer | 336/200 |
| 2001/0033204 | A1 * | 10/2001 | Simburger et al. | 333/24 R |
| 2004/0108935 | A1 * | 6/2004 | Kyriazidou | 336/200 |
| 2005/0093668 | A1 * | 5/2005 | Bueyuektas et al. | 336/200 |
| 2006/0192645 | A1 * | 8/2006 | Lee et al. | 336/200 |
| 2007/0126544 | A1 * | 6/2007 | Wotherspoon et al. | 336/200 |
| 2008/0094166 | A1 * | 4/2008 | Hsu et al. | 336/223 |
| 2008/0303622 | A1 * | 12/2008 | Park et al. | 336/200 |

* cited by examiner

*Primary Examiner* — Mohamad Musleh
*Assistant Examiner* — Mangtin Lian
(74) *Attorney, Agent, or Firm* — Rabin & Berdo, P.C.

(57) ABSTRACT

A stacked inductor with combined metal layers is represented in this invention. The stacked inductor includes: a top layer metal coil, and at least two lower layer metal coils, the metal coils being aligned with each other; adjacent metal coils being connected at the corresponding ends through a via; wherein, each of the lower layer metal coils is consisted of plural layers of metal lines which are interconnected. With the same chip area, the stacked inductor of the present invention can achieve higher inductance and Q factor because of the mutual inductance generated from the plural layers of metal lines and the reduced parasitic resistance.

12 Claims, 4 Drawing Sheets

STACKED INDUCTOR

BACKGROUND OF THE INVENTION

1. Field of the Invention

The invention is related to micro-electronics and more particularly to an on-chip stacked inductor having high quality factor for RF application.

2. Description of Related Art

At present, integrated circuits usually contain a lot of passive devices. One of the most important components in RF CMOS/BiCMOS integrated circuits is on-chip inductor. Inductors have great impact on the RF characteristic in common wireless products. The design and analysis for this component has been widely researched as a result. Nowadays, on-chip inductors with high Q factor are widely used in voltage controlled oscillator, low noise amplifier and other RF building blocks. On-chip stacked inductors can reduce the chip area in a large extent, thus reducing the production cost.

Quality factor (Q factor) of an inductor is a major factor to indicate the performance of the inductor. High Q factor leads to low magnetic loss and high efficiency of the inductor.

A conventional stacked inductor as shown in FIG. 1 is composed of a first coil in an upper metal layer and a second coil in a lower metal layer. Both coils are formed with only one layer of metal. Since the thickness of the lower metal layer is smaller than that of the upper metal layer, the resistance of the second coil is higher than the resistance of the first coil, which causes relatively high parasitic resistance. Although the above stacked structure can increase the inductance by more than two times compared with a single-layer inductor having the same chip area, the high resistance of the lower metal layer leads to the degradation of the Q factor. As a result, it could not meet the requirement of circuit design.

SUMMARY OF THE INVENTION

The object of the present invention is to provide a stacked inductor which has a greater inductance than conventional inductors of the same area, and keeps a high Q factor.

To achieve the above object, the present invention provides a stacked inductor, which includes: a top layer metal coil, and at least two lower layer metal coils, the metal coils being aligned with each other; adjacent metal coils being connected at the corresponding ends through a via; wherein, each of the lower layer metal coils is consisted of plural layers of metal lines which are interconnected.

The advantage of the present invention is: increasing the inductance of the stacked inductor without increasing the chip area; increasing the thickness of the lower layer metal coils by interconnecting plural layers of metal lines to form one metal coil, thus keeping a high Q factor.

BRIEF DESCRIPTION OF THE DRAWINGS

These and other features of this invention will be more readily understood from the following detailed description of the invention take in conjunction with the accompanying drawings in which.

DETAILED DESCRIPTION OF THE INVENTION

The stacked inductor of the present invention has a multi-layer structure, which includes at least three layers of metal coils. The first layer of metal coil from top down is defined as a top layer metal coil; the other layers of metal coils below the top layer metal coil are defined as lower layer metal coils. The at least three metal coils are aligned with each other in the vertical direction. Each metal coil has one or more turns while the critical dimension of the coils and the interval between two turns are the same. Adjacent metal coils are connected at the corresponding ends through a via. Each of the lower layer metal coils is consisted of two or more layers of metal lines, and the metal lines are connected to each other by slots.

Figure 1:
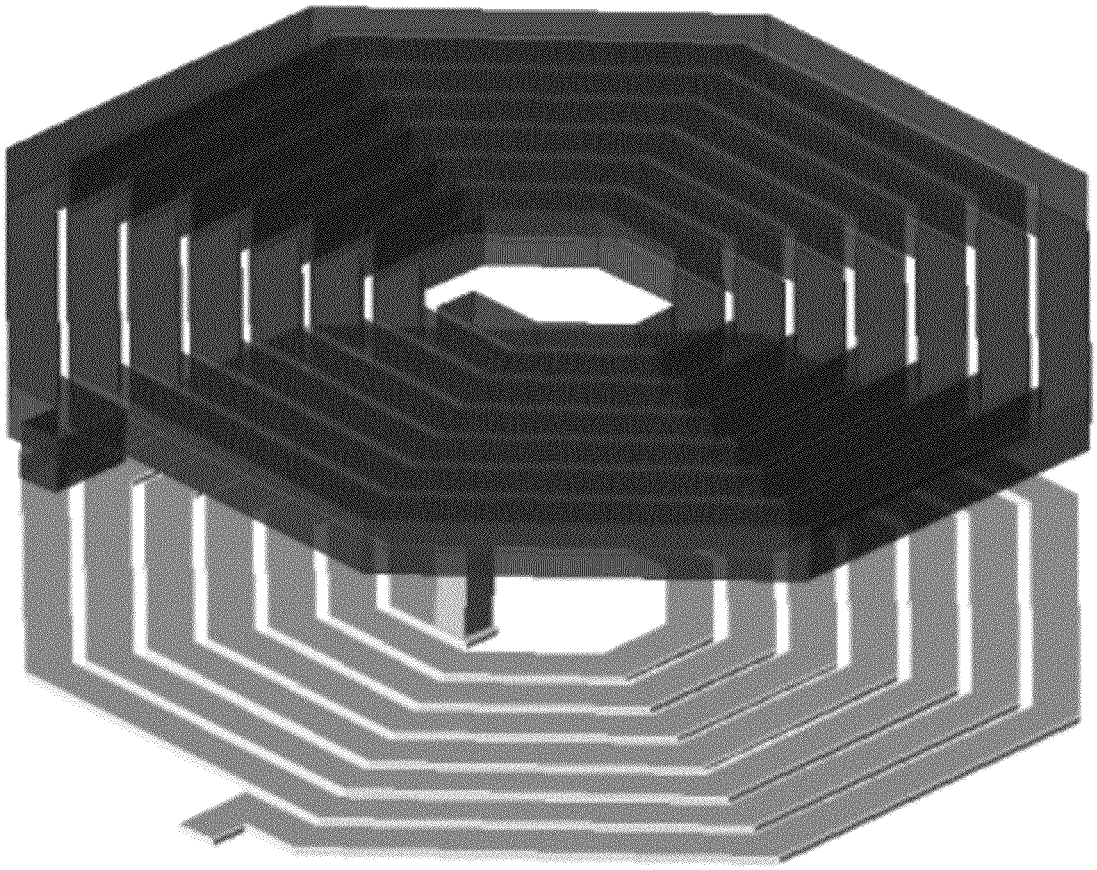
(Prior Art) Fig. 1
FIG. 1 is a stereogram of a conventional stacked inductor.
Figure 2:
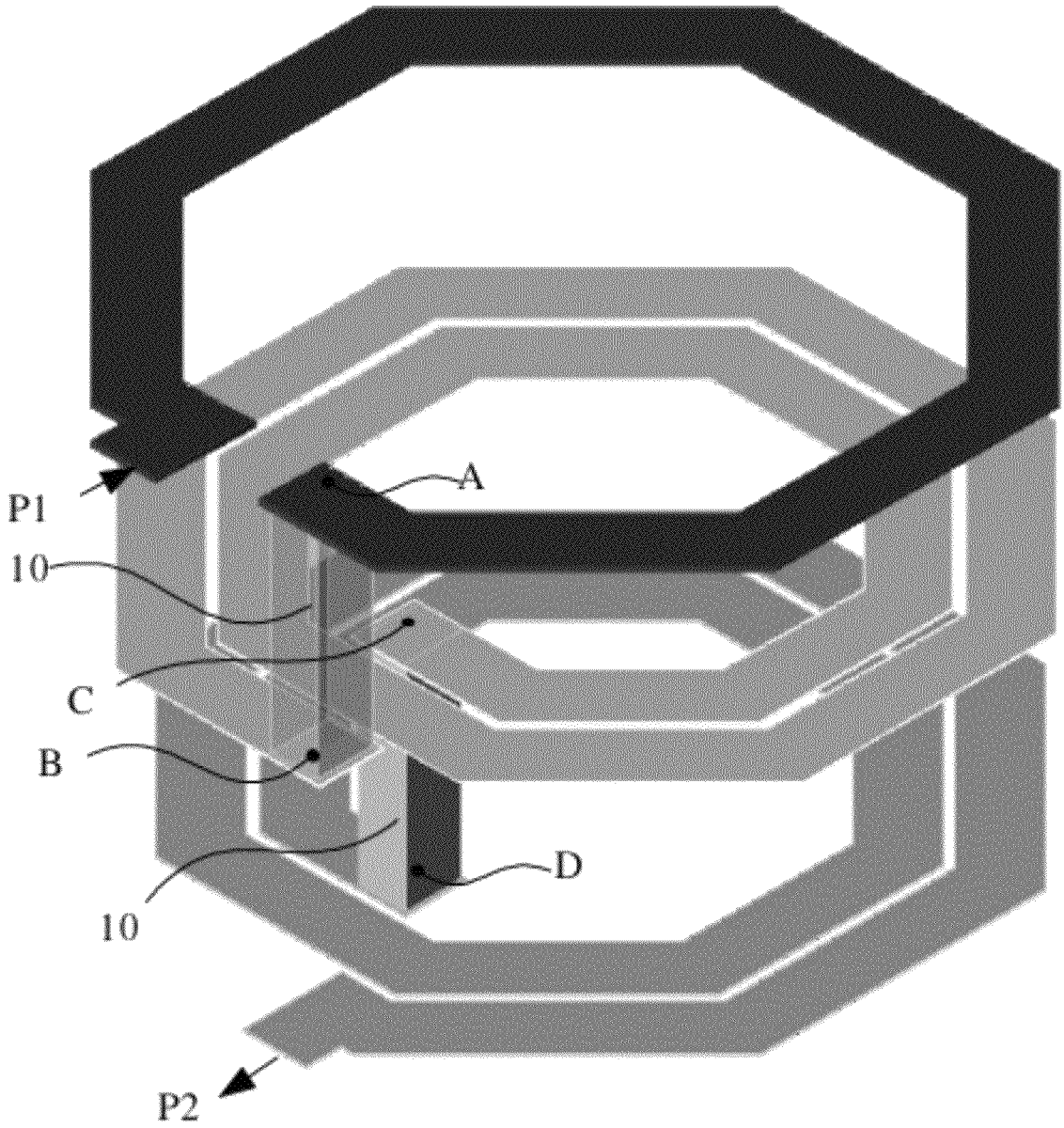
FIG. 2 is a stereogram of the stacked inductor according to one embodiment of the present invention.

In detail, the stacked inductor according to one embodiment of the present invention as shown in FIG. 2 has three layers of metal coils vertically aligned with each other. The three coils have the same critical dimension and the same interval between adjacent turns. The lower layer metal coils other than the top layer metal coil are consisted of two layers of metal lines interconnected through slots. The metal lines have the same shape, and are vertically aligned with each other. The inductor coil is winded in such a manner that it starts from one end of the top layer metal coil, this end also being the first port P1 of the stacked inductor; after one turn, the other end of the top layer metal coil is connected through a via 10 to the peripheral end of the second layer metal coil located below the top layer metal coil; after two or more turns, the inner end of the second layer metal coil is connected through a via 10 to the inner end of the third layer metal coil located below the second layer metal coil; after two or more turns, the inductor coil goes to the peripheral end of the third layer metal coil. If the third layer metal coil is not the bottom layer metal coil, connect the peripheral end of the third layer metal coil to the metal coil below, otherwise the inductor coil ends at the peripheral end of the third layer metal coil, which is also the second port P2 of the stacked inductor.

By using this new structure, the inductance can be increased by more than two times with the same chip area because of the mutual inductance generated by the multiple layers of metal lines. Since each of the lower layer metal coils is composed of several layers of metal lines, the thickness of the lower layer metal coil is largely increased, and therefore, the parasitic resistance is reduced.

It is known that the quality factor or Q factor of an inductor can be expressed as:

$$Q \approx \frac{wL}{R_s}$$

Wherein, Q represents the quality factor, w represents the frequency, L represents the inductance under a certain frequency, and $R_s$ represents the resistance under a certain frequency. The present invention effectively utilizes the mutual inductance of the multiple layers of metal lines to increase the total inductance and reduce the $\Delta R_s$ (the increment of parasitic resistance). As a result, the Q factor is greatly increased.

Figure 3:
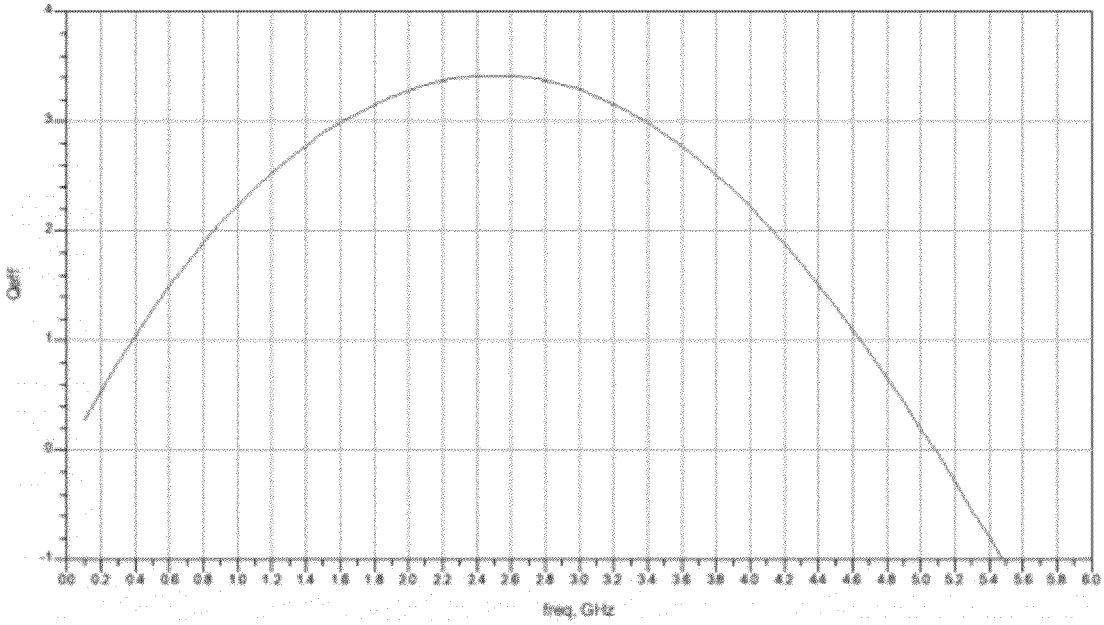
FIG. 3 illustrates the relationship between the Q factor and the frequency of a conventional stacked inductor.
Figure 4:
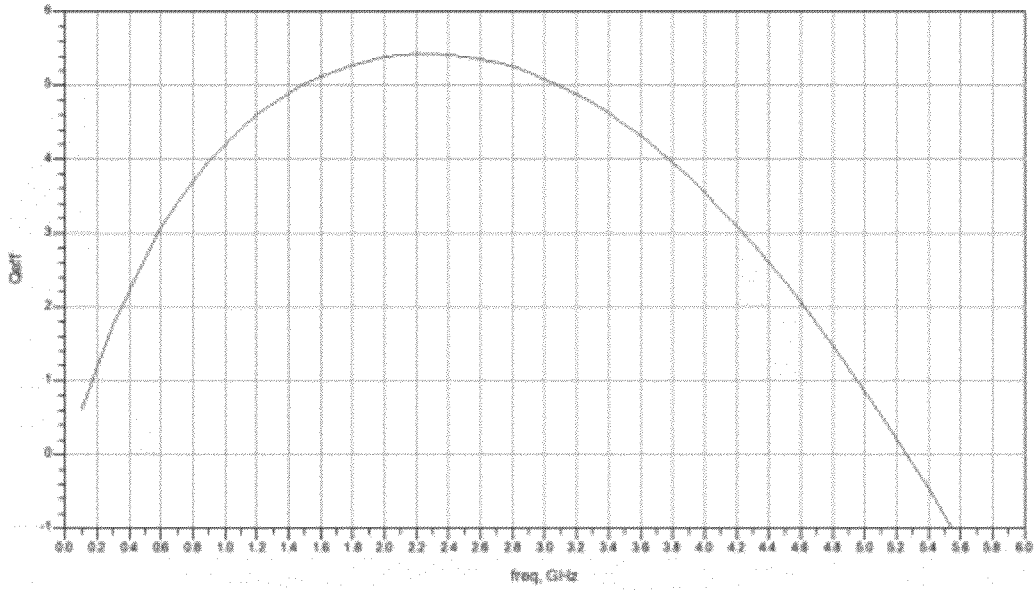
FIG. 4 illustrates the relationship between the Q factor and the frequency of the stacked inductor according to one embodiment of the present invention.

As shown in FIG. 2, one embodiment of the present invention adopts a three-layer structure with an outside diameter of 160 μm. The top layer metal coil has 1 turn. The critical dimension of the top layer metal coil is 8 μm. The thickness of the top layer metal coil is 3 μm. The two lower layer metal coils respectively have 2 turns. Each of the two lower metal coils has a critical dimension (width of the metal line) of 8 μm, and the interval between the 2 turns is 2 μm. It is indicated from FIG. 3 and FIG. 4 that the Q factor of the new structure which adopts multiple layers of metal lines has increased by more than 20% compared with the conventional structure that adopts only one layer of metal line.

With this new structure, miniaturized stacked inductors with large inductance and high Q factor can be realized.

Figure 5:
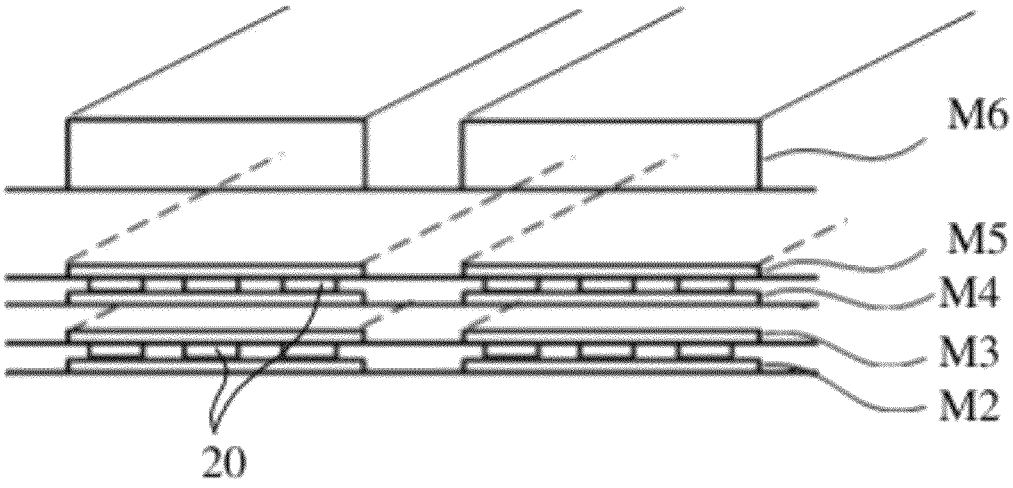
FIG. 5 is a cross section view of the stacked inductor having a two-layer metal line structure according to one embodiment of the present invention.

As shown in FIG. 5, the stacked inductor according to one embodiment of the present invention can be manufactured by the traditional RFIC process with 6 metal layers. The top (sixth) metal layer has a thickness of 3 μm, the second to the fifth metal layers are thin metal films with a thickness of 0.43 μm, wherein, a dielectric layer with a thickness of 0.55 μm is formed between the fifth and the fourth metal layers as well as between the third and the second metal layers.

Please refer to FIG. 2 and FIG. 5, the top layer of the stacked inductor is the sixth metal layer M6; the inductor coil starts from the first port P1 of the stacked inductor and reaches position A after one turn, then reaches position B by passing through a via 10. The second layer of the stacked inductor is combined by the fifth and the fourth metal layers M5 and M4, that is to say, metal lines of the same shape are respectively formed in the fifth and the fourth metal layers, the metal lines being connected in parallel by slots 20 formed in the dielectric layer between the fifth and the fourth metal layers M5 and M4. The combined metal layers are equivalent to a thick metal layer. The inductor coil in the second layer reaches position C after two turns, and reaches position D by passing through a via 10. The third layer of the stacked inductor is combined by the third and the second metal layers M3 and M2 which are connected through slots 20. The combined third and second metal layers are also equivalent to a thick metal layer. The inductor coil in the third layer reaches the second port P2 of the stacked inductor after two turns.

Figure 6:
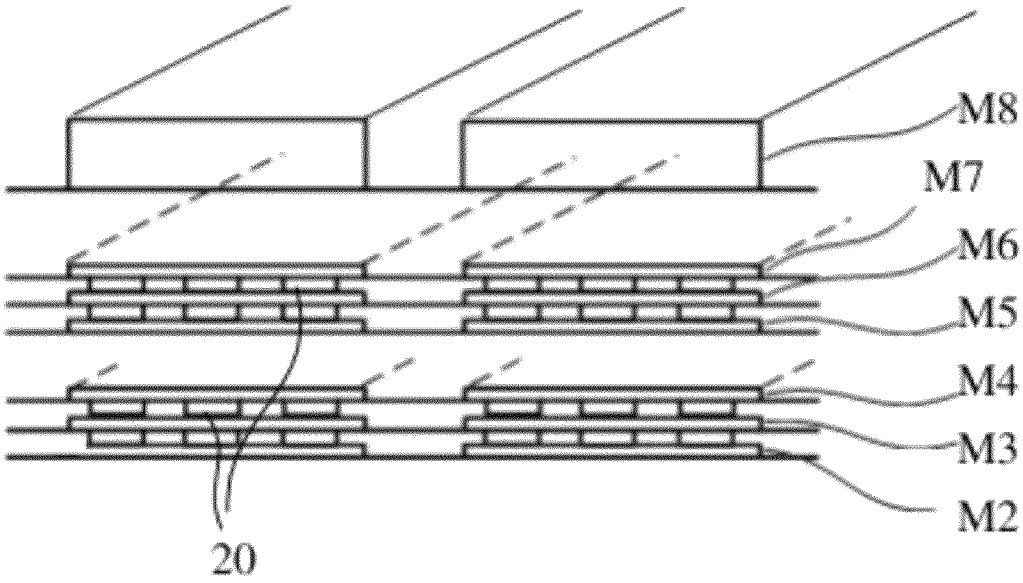
FIG. 6 is a cross section view of the stacked inductor having a three-layer metal line structure according to another embodiment of the present invention.

In other processes with multiple metal layers, more than two layers of metal lines, such as three metal layers, can be combined. According to another embodiment of the present invention as shown in FIG. 6, the top layer of the three-layer stacked inductor is the top (eighth) metal layer M8; the second layer of the stacked inductor is combined by the seventh to the fifth metal layers M7~M5, the third layer of the stacked inductor is consisted of the fourth to the second metal layers M4~M2, wherein, the seventh to the fifth metal layers M7~M5 are isolated by two dielectric layers and are connected in parallel by the slots 20 formed in the dielectric layers; the fourth to the second metal layers M4~M2 are also isolated by two dielectric layers and are interconnected by slots 20.

Although the present invention has provided embodiments that the top layer metal coil has 1 turn, and the layer metal coils have 2 turns. Persons of skills in the art should understand that the number of turns in the top and/or lower layer metal coils can be changed to one or more turns according to the requirement of the inductance as long as the corresponding ends of adjacent metal coils are vertically aligned with each other and can be connected through a via. In addition, the number of combined metal layers can be adjusted according to the specific process. The shape of the stacked inductor can be polygon (preferably octagon), circle or other shapes. The metal coils can be winded in the clockwise or the anticlockwise direction.

The structure of the stacked inductor of the present invention is not limited to a three-layer structure. Other numbers of layers are also suitable for this structure. The present invention is particularly applicable to those stacked inductors that the top layer metal coil is the top metal layer and the lower layer metal coil starts from the second metal layer from the top. However, other arrangements of metal layers are also suitable for this structure.

While the invention has been particularly shown and described with reference to the preferred embodiments thereof, it will be understood by those skilled in the art that various changes in form and details may be made without departing from the spirit of the invention or from the scope of the appended claims.

What is claimed is:

1. A stacked inductor, comprising:

a top layer metal coil; and at least two lower layer metal coils, all of the metal coils being aligned with each other, wherein adjacent ones of the metal coils are connected at corresponding ends thereof through a via, further wherein, each of the lower layer metal coils includes plural layers of metal lines which are interconnected, each of the plural layers of metal lines being formed of a solid material so as to not include any cavity, further wherein in each of the lower layer metal coils the respective plural layers of metal lines are interconnected by slots, further wherein the plural layers of metal lines are isolated from each other by dielectric layers, each of the slots being formed in a corresponding one of the dielectric layers, further wherein the top layer metal coil has a first thickness and each of the metal lines has a thickness smaller than that of the first thickness further wherein the plural layers of metal lines in one of the lower layer metal coils are connected in parallel to each other.

2. The stacked inductor according to claim 1, wherein the plural layers of metal lines in one of the lower layer metal coils have the same pattern.

3. The stacked inductor according to claim 1, wherein the top layer metal coil and the lower layer metal coils have the same critical dimension.

4. The stacked inductor according to claim 1, wherein the top layer metal coil and the lower layer metal coils each have one or more turns, the intervals between adjacent turns being the same.

5. The stacked inductor according to claim 1, wherein all of the metal coils are polygonal or circular.

6. The stacked inductor according to claim 5, wherein all of the metal coils are octagonal.

7. The stacked inductor according to claim 1, wherein all of the metal coils are winded in the clockwise or the anticlockwise direction.

8. The stacked inductor according to claim 1, wherein the top layer metal coil has less turns than any of the lower layer metal coils.

9. A stacked inductor, comprising:

a top layer metal coil including a single layer having a first thickness; and at least two lower layer metal coils, all of the metal coils being aligned with each other, wherein adjacent ones of the metal coils are connected at corresponding ends thereof through a via, further wherein each of the lower layer metal coils includes plural layers of metal lines which are interconnected, further wherein each of the metal lines has a thickness smaller than the first thickness further wherein the plural layers of metal lines in one of the lower layer metal coils are connected in parallel to each other.

10. The stacked inductor according to claim 9, wherein the plural layers of metal lines in each of the lower layer metal coils are interconnected by slots.

11. The stacked inductor according to claim 10, wherein the plural layers of metal lines are isolated from each other by dielectric layers, each of the slots being formed in a corresponding one of the dielectric layers.

12. The stacked inductor according to claim 9, wherein the top layer metal coil has less turns than any of the lower layer metal coils.

* * * * *